United States Patent [19]

Fukuda et al.

[11] Patent Number: 5,040,024

[45] Date of Patent: Aug. 13, 1991

[54] VESSEL FOR DEVELOPER

[75] Inventors: Hideo Fukuda, Katano; Mikio Ido, Sakai; Naoki Motobayashi, Tondabayashi, all of Japan

[73] Assignee: Mita Industrial Co., Ltd., Osaka, Japan

[21] Appl. No.: 356,510

[22] Filed: May 25, 1989

[30] Foreign Application Priority Data

Nov. 30, 1988 [JP] Japan ..... 63-303041

[51] Int. Cl.[5] ..... G03G 15/06

[52] U.S. Cl. ..... 355/260; 222/DIG. 1

[58] Field of Search ..... 355/200, 210, 245, 260; 222/DIG. 1

[56] References Cited

U.S. PATENT DOCUMENTS

| | | | |
|---|---|---|---|
| 4,491,161 | 1/1985 | Tamura et al. | 355/260 X |
| 4,752,807 | 6/1988 | Mort | 355/260 |
| 4,851,873 | 7/1989 | Sakao et al. | 355/260 X |

FOREIGN PATENT DOCUMENTS

| | | | |
|---|---|---|---|
| 58-97068 | 6/1983 | Japan | 355/260 |
| 59-102262 | 6/1984 | Japan | 355/260 |
| 60-154272 | 8/1985 | Japan | 355/260 |
| 62-121470 | 6/1987 | Japan | 355/260 |
| 63-137259 | 6/1988 | Japan | 355/260 |
| 63-178274 | 7/1988 | Japan | 355/260 |

*Primary Examiner*—Fred L. Braun

*Attorney, Agent, or Firm*—H. Jay Spiegel

[57] ABSTRACT

An electrophotographic copying machine developer vessel includes a vessel proper having a closed top, a barrel and a tapered inclined portion continuous to the barrel. The developer vessel also includes a receiving plate removably attachable to the vessel proper, the receiving plate having a substantially flat supporting surface, substantially straight two side edges for attachment to the developing device and an opening communicating with the vessel proper. An opening tab composed of a film which covers the opening of the receiving plate is peelably bonded to the flat supporting surface thereof. A shutter is provided which includes a plate having, on both the sides thereof, engagement portions to be engaged with both the side edges of the receiving plate. The shutter may engage the receiving plate of the developer vessel such that when the developer vessel is removed from a copying machine, the presence of the shutter thereunder prevents scattering of developer in the environment.

7 Claims, 9 Drawing Sheets

VESSEL FOR DEVELOPER

BACKGROUND OF THE INVENTION

1. Field of the Invention

The present invention relates to a vessel for a developer. More particularly, the present invention relates to a developer vessel which is used for containing a developer therein and is attached to a developing device of an electrophotographic copying machine and used as a developer hopper.

2. Description of the Prior Art

In the field of electrophotographic copying machines, a powdery developer generally called "toner" is used. This powdery developer is composed of a powdery dispersion of a colorant such as carbon black and, if necessary, a charge-controlling agent in a binder resin. From the view of the resolving power in a formed image, the powder is formed of finely divided particles, and in view of the image density, a large coloring power is given to this powder. Moreover, in view of the adaptability to the developing operation, an excellent flowability is given to this powder. In general, this powder is filled and packed in a vessel and supplied to users of copying machines. However, because of the above-mentioned characteristics, at the time of opening of the vessel or supply of the powder to the developer hopper, the powder is scattered around to contaminate the hands of an operator and surroundings of a copying machine.

Many proposals have been made to prevent scattering of a toner at the time of opening of the developer vessel or supply of the toner. For example, Japanese Utility Model Publication No. 62-41325 proposes a developer cartridge which is fitted and inserted in a developing device of an electrophotographic copying machine in the state where an opening is located above and which is turned to locate the opening below so that a developer is supplied from the opening, said developer cartridge comprising a guide member for maintaining the cartridge at the time of insertion so that the opening is located above, a seal member for sealing the opening, and a folded portion formed by folding the seal member on the cartridge insertion side, wherein the seal member is opened while the cartridge is being inserted.

Furthermore, Japanese Unexamined Utility Model Publication No. 62-14458 discloses a developer vessel comprising a vessel proper for containing a developer therein, an adapter sleeve member fitted integrally to a mouth portion of the vessel proper and rotatably attached and fitted to a supply opening of a developer hopper, a first shutter member having an opening, which is fixed to the adapter sleeve member, and a second shutter member having an opening, which is rotatably arranged within the adapter sleeve member, wherein supply of the developer into the hopper is made possible by bringing both the openings in line with each other.

In each of these developer vessels, a developer in a packaging vessel is discharged into a hopper, and the developer is stored in the hopper and is used, and therefore, it is necessary to provide two spaces in a copying machine, that is, a space for the hopper for storing the developer therein and a space for insertion of the cartridge for discharging the developer to the hopper.

In the case where a packaging vessel for a developer is attached within a copying machine and is used as the hopper for storing the developer therein and perpetually supplying the developer into a developing device, it is expected that the necessary space of the copying machine will be reduced and the size of the copying machine will be diminished, but in this case, it is difficult to prevent scattering of the developer when the vessel is opened and the vessel is attached to the developing device.

SUMMARY OF THE INVENTION

It is therefore a primary object of the present invention to provide a developer vessel for containing a developer therein, which is attached to a developing device of an electrophotographic copying machine and is used as a developer hopper, wherein opening of the vessel and attachment of the vessel to the developing device can be accomplished easily without scattering of a developer.

Another object of the present invention is to provide a developer vessel in which the above function can be exerted by a relatively simple structure.

More specifically, in accordance with the present invention, there is provided a developer vessel for containing a developer therein, which is attached to a developing device of an electrophotographic copying machine and is used as a developer hopper, said developer vessel comprising a vessel proper having a closed top, a barrel and a tapered inclined portion continuous to the barrel, recited from the top in the state where the vessel is attached to the developing device, a receiving plate formed integrally with the vessel proper, which has a substantially flat supporting surface, substantially straight two side edges for attachment to the developing device and an opening communicating with the vessel proper, an opening tab composed of a film which covers the opening of the receiving plate and is peelably bonded to the flat supporting surface, and a shutter composed of a plate having, on both the sides, engagement portions to be engaged with both the side edges of the receiving plate, wherein said film has a width smaller than the distance between both the attachment side edges of the receiving plate, and said film has such a length that the film is folded on the fitting and inserting end of the receiving plate and the lapel of the folded film is protruded from the other end of the receiving plate.

According to one preferred embodiment of the present invention, the vessel proper has a short cylindrical neck having a screw formed on the outer periphery thereof on the top end of the inclined portion and is integrally blow-formed from a plastic material, the receiving plate has, on the side opposite to the supporting surface and around the opening, a short cylindrical connecting portion having a screw formed on the inner circumference thereof and is integrally injection-formed from a plastic material, and the screw of the neck and the screw of the connecting portion are engaged with each other to integrate the vessel proper and the receiving plate with each other.

According to another preferred embodiment of the present invention, the vessel proper has, on the top of the inclined portion, a short cylindrical neck having a plurality of projections extending outward of the radius on the outer periphery thereof and is integrally blow-formed from a plastic material, the receiving plate has, on the side opposite to the supporting surface and around the opening, a short cylindrical connecting portion having a screw on the inner circumference and is integrally injection-formed from a plastic material, and the projections of the neck are engaged with the engagement part of the connecting portion to integrate the vessel proper and the receiving plate with each other.

According to still another preferred embodiment of the present invention, the shutter has, as an engagement part, a concave groove slidably engaged with both the side edges of the receiving plate, and when the developer vessel is dismounted from the developing device, dismounting is effected by sliding the developer vessel in the state where both the side edges are fitted and inserted in the concave groove.

Figure 1:
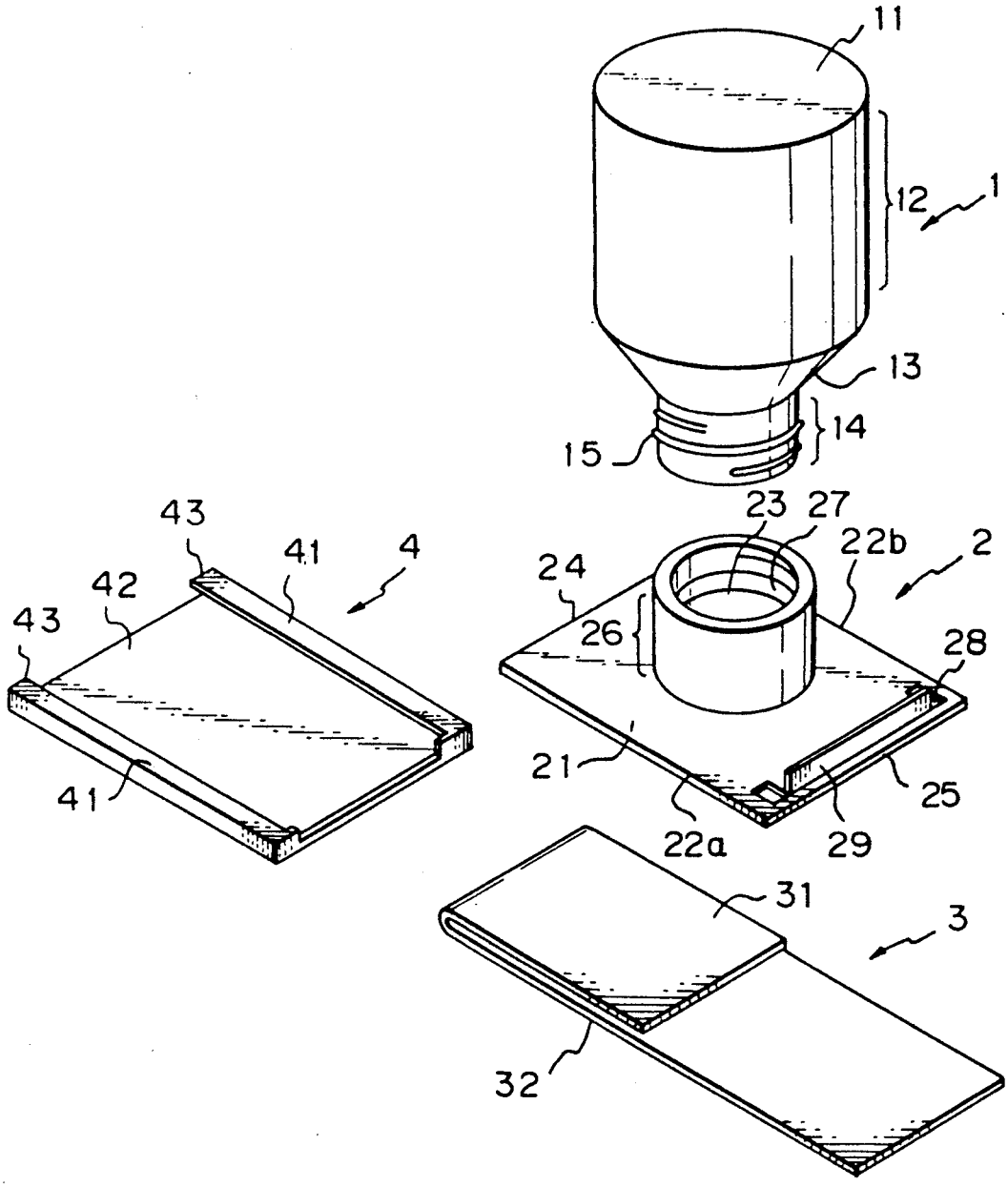
FIG. 1 is a diagram systematically illustrating respective members of a developer vessel according to one embodiment of the present invention.

In the drawings, reference numerals represent the following members and parts.

1: vessel proper, 2: receiving plate, 3: opening tab, 4: shutter, 5: developer supply portion, 21: flat supporting surface of receiving plate, 22: both the side edges of receiving plate, 24: fitting and insertion end, 31: portion to be bonded of opening tab, 32: free lapel portion of opening tab, 41: engagement portion, 43: slidably engaged concave groove, 51: fitting and insertion portion, 53: developer delivery mechanism, 56: seal member, 60: positioning engagement projection.

DETAILED DESCRIPTION OF THE PREFERRED EMBODIMENTS

In a general way, the developer vessel of the present invention comprises a vessel proper, a receiving plate, an opening tab and a shutter. The vessel proper comprises a closed portion acting as the bottom when the vessel proper is used as the packaging vessel and acting as the top when the vessel proper is used as the hopper, a barrel and a tapered inclined portion (frustoconical shoulder). The receiving plate is arranged integrally with the vessel proper so that the receiving plate is connected to the inclined portion of the vessel proper. One of the characteristic features of the developer vessel of the present invention is that a substantially flat surface, substantially straight two side edges for fitting and attachment to a developing device and an opening communicating with the vessel proper are formed on the receiving plate. More specifically, the opening of the receiving plate exerts a function of filling the developer in the vessel proper and a function of discharging or feeding the developer in the vessel proper when the vessel proper is used as the hopper. Since substantially straight side edges are formed on both the ends of the receiving plate, only by fitting and inserting the receiving plate in the state where the opening is located below, attachment to the developing device and dismounting therefrom can be accomplished easily and assuredly. Moreover, since the substantially flat surface is formed, attachment of an opening tab described hereinafter can be performed easily.

The second characteristic feature of the developer vessel of the present invention is that an opening tab composed of a film is peelably bonded to the flat supporting surface to cover the opening of the receiving plate and this film has a width smaller than the distance between both the attachment side edges of the receiving plate and has such a length that the film is folded on the fitting and inserting end of the receiving plate and the lapel of the folded film is protruded from the other end of the receiving plate.

According to the present invention, by dint of the foregoing characteristic features, the developer vessel can be opened in the state where the developer vessel is attached as the hopper to the developing device, and the trouble of scattering of the developer powder can be effectively eliminated. In the first place, since the opening tab is bonded to the flat supporting surface of the receiving plate to cover the opening of the receiving plate scattering of the developer and contact of the developer with the outer atomosphere can be effectively prevented until the developer vessel is attached as the hopper to the developing device and is opened. Furthermore, since the film of the opening tab is peelably bonded to the receiving plate, opening can be performed by peeling the film of the opening tab from the supporting surface of the receiving plate as occasion demands. Moreover, since the width of the film of the opening tab is smaller than the distance between both the side edges of the receiving plate, peeling is possible in the state where both the side edges of the receiving plate are completely fitted in the developing device, and since the film of the opening tab is formed with such a length that the film is folded on the fitting and inserting end of the receiving plate and the lapel of the folded film is protruded from the other end of the receiving plate, the grip portion of the film is located outside even in the state where both the side edges are completely fitted to the developing device, and the film can easily be peeled from the supporting surface of the receiving plate by pulling this grip portion.

Still further, in the present invention, since a shutter having, on both the sides thereof, engagement portions that are dismountably engaged with both the side edges of the receiving plate, the film covering the opening can be effectively protected.

The present invention will now be described with reference to embodiments illustrated in the accompanying drawings.

FIG. 1 illustrates systematically respective members of a developer vessel according to one embodiment of the present invention in the disintegrated state. This developing vessel comprises a vessel proper 1, a receiving plate 2, an opening tab 3 and a shutter 4. The vessel proper 1 is blow-formed from a single-layer or multi-player plastic parison, and the vessel proper 1 comprises a closed portion 11 acting as the bottom when the vessel is used as the packaging vessel and acting as the top when the vessel is used as the hopper, a barrel 12 and an inclined portion (frustoconical portion) 13 tapered toward the top end. In this embodiment, a short cylindrical neck 14 is formed on the top end of the inclined portion 13, and a male screw 15 for connection to the receiving plate 2 is formed on the outer periphery of the neck 14.

The receiving plate 2, for example, is injection-formed from a plastic material, and the receiving plate 2 has a substantially flat surface 21, substantially straight side edges 22*a* (22*b*) for fitting and attachment to the developing device, and an opening 23 communicating with the vessel proper 1. The receiving plate 2 has a substantially square or rectangular shape, and it will be understood that the receiving plate 2 has an end 24 for fitting and insertion into the developing device and an opposite end 25. In this embodiment, the receiving plate 2 has a short cylindrical connecting portion 26 on the side opposite to the flat supporting surface 21 and around the opening 23, and a clamping female screw 27 is formed on the inner circumference of the connecting portion 26. By engaging the male screw 15 of the vessel proper 1 with the female screw 27 of the receiving plate 2, the vessel proper 1 and receiving plate 2 are clamped and integrated with each other.

An engagement hole 28 or projection can be formed on the receiving plate 2 for regulating the position of the receiving plate 2 when it is fitted and attached to the developing device. Furthermore, a dismounting grip 29 can be formed.

Figure 2:
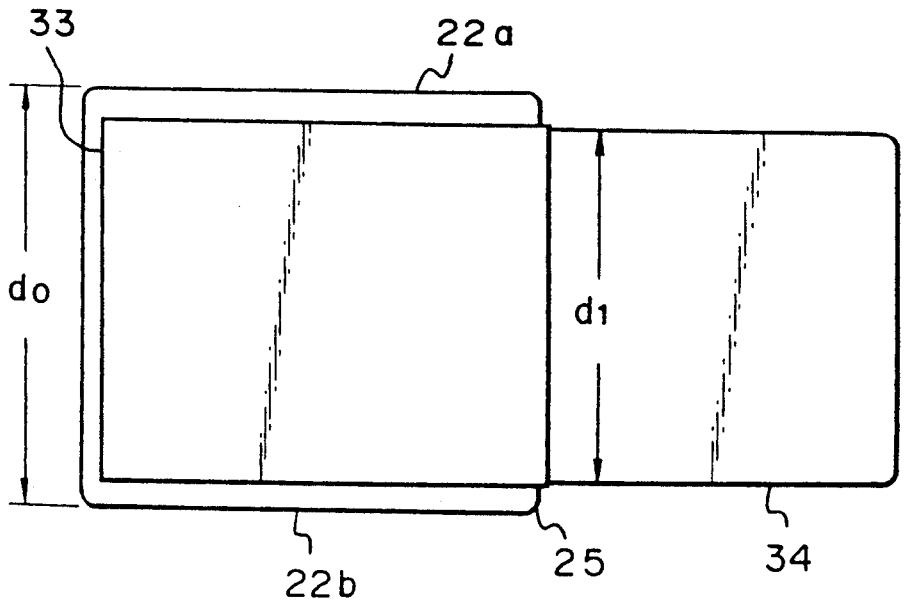
FIG. 2 is a bottom view illustrating a receiving plate in the state where an opening tab is bonded to the receiving plate.
Figure 3:
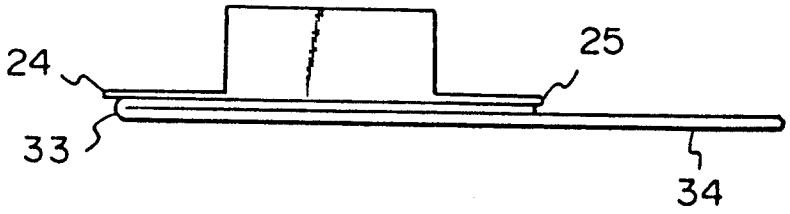
FIG. 3 is a side view illustrating the receiving plate in the state where the opening tab is bonded to the receiving plate.

A single-layer or multi-layer plastic film or a plastic film/aluminum foil laminate is used for the opening tab 3. The opening tab 3 comprises a portion 31 to be bonded to the flat supporting surface 21 of the receiving plate 2 and a free lapel portion 32. As shown in FIG. 2, this film 3 has a width $d_1$ shorter than the distance $d_0$ between both the side edges 22*a* and 22*b* of the receiving plate 2 for fitting and attachment to the developing device, and as shown in FIG. 3, the film 3 is folded along a folding line 33 in the vicinity of the fitting and inserting end 24 of the receiving plate 2 and a grip portion 34 is protruded outward from the opposite end 25 of the receiving plate 2. At least the surface, confronting to the receiving plate 2, of the opening tab 3 should be composed of a peelably bondable material, especially a heat-sealable material. By the peelable bonding or peelable heat sealing is meant a bonding or heat sealing capable of keeping a sealing state in an ordinary storage state but capable of being peeled by hands, and in general, a bonding or heat sealing having a seal strength (peel strength) of 100 to 1500 g/1.5 cm of the width is meant. For example, it is impossible to attain a peelable bonding between polyethylene sheets or between polypropylene sheets but if a sealing layer of a blend comprising polyethylene (polypropylene) and a small amount of other resin such as polypropylene (polyethylene) or a rubber is used, it is possible to provide a peelable heat sealing.

Figure 4:
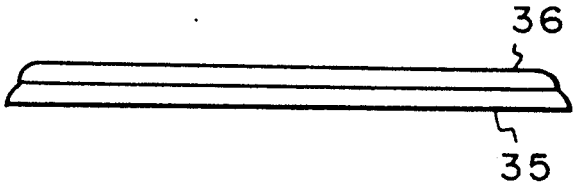
FIG. 4 is a diagram illustrating the sectional structure of the opening tab.

FIG. 4 shows the sectional structure of an example of the opening tab preferably used in the present invention. A peelable heat-sealing layer 36 composed of a blend as mentioned above is formed on one surface of a base film 35.

Figure 5:
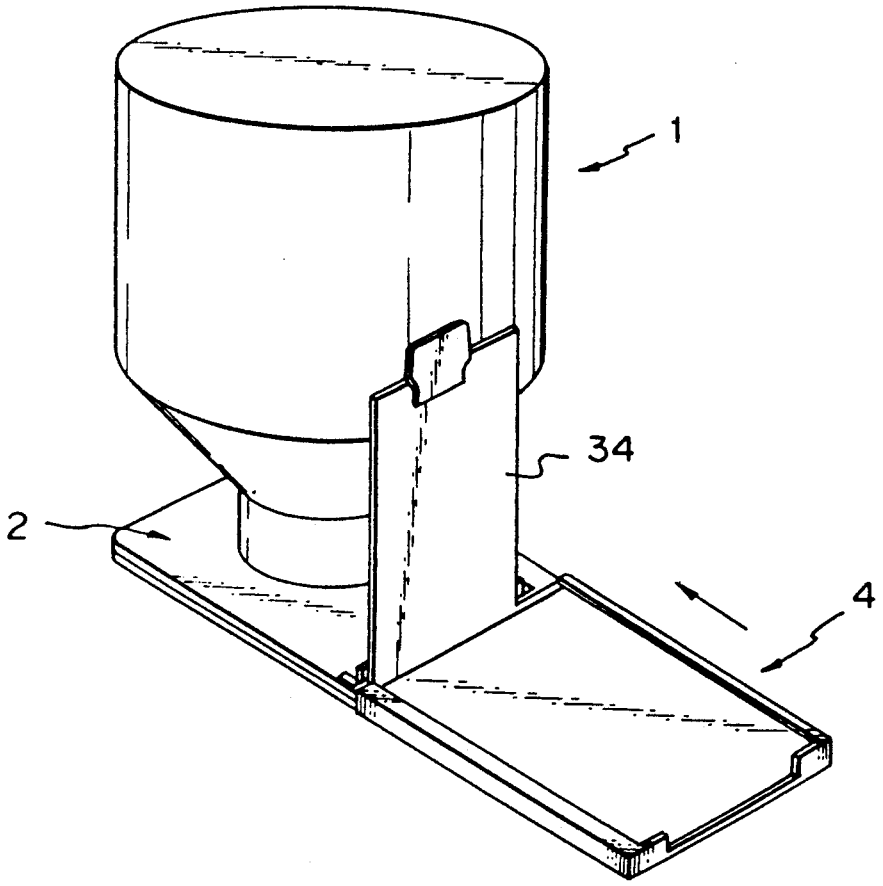
FIG. 5 is a view illustrating the entire developer vessel according to the embodiment of the present invention.

The shutter 4 comprises a plate 42 having an engagement part 41 to be detachably engaged with both the side edges of the receiving plate. In the present embodiment, the engagement part 41 comprises a concave groove 43 slidably engaged with the side edges 22*a* (22*b*) of the receiving plate. As shown in FIG. 5, assembling of the developer vessel is completed by engaging the shutter 4 with the receiving plate 2 having the opening tab 3 peelably bonded thereto. Incidentally, the grip portion 34 is secured to the barrel 12 by bonding.

Figure 6A:
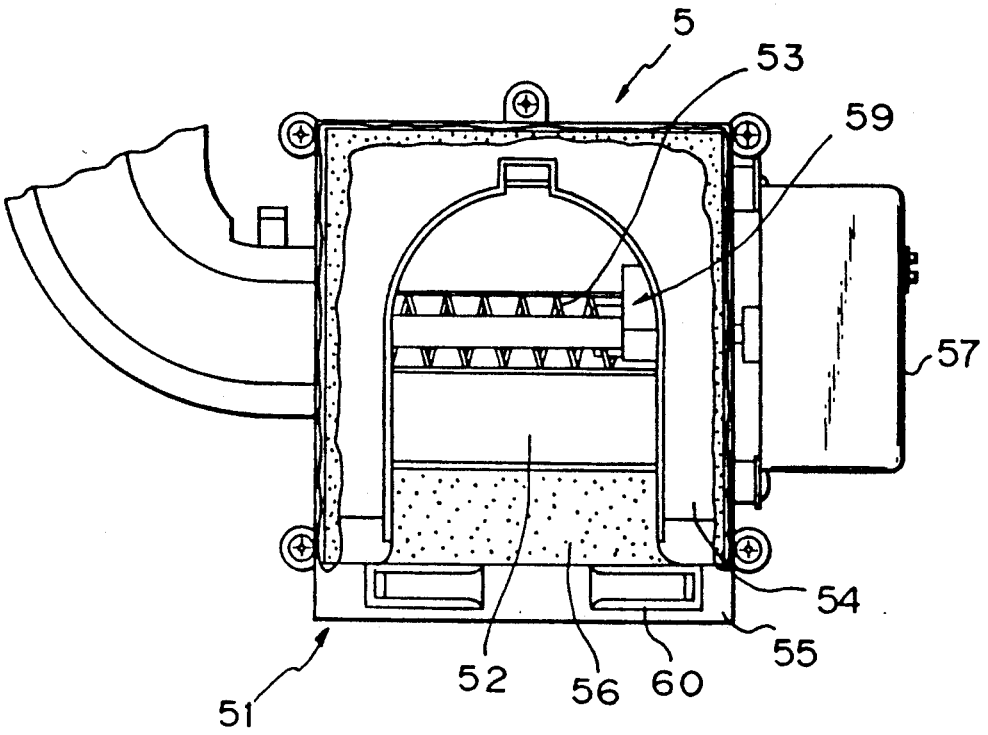
FIG. 6 is a diagram showing a main portion of a developing device to which the developer vessel according to the embodiment of the present invention is attached, in which FIG. 6 (*a*) is a plane view and FIG. 6 (*b*) is a side view.
Figure 6B:
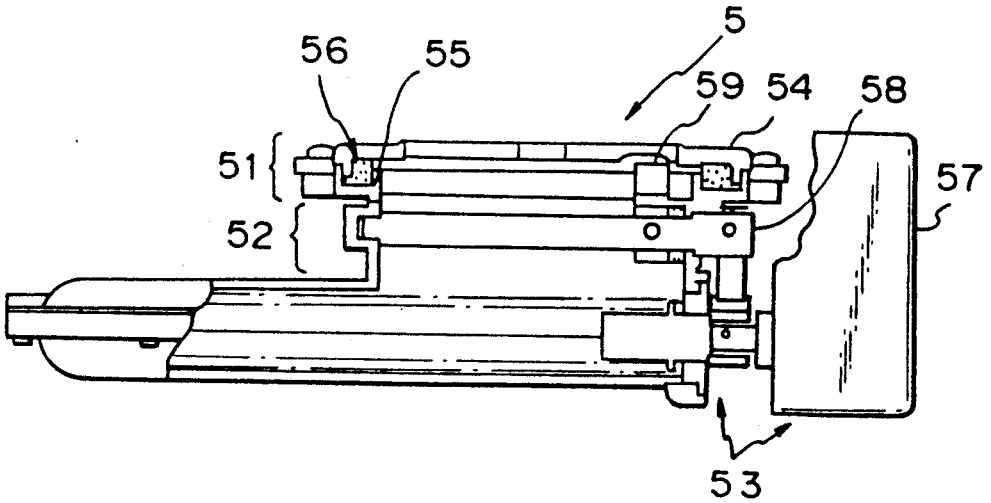

Referring to FIGS. 6-(*a*) and 6-(*b*) showing a main portion of the developing device to which the developer vessel of the present invention is attached, a developer supply zone 5 comprises, in general, a fitting portion 51 capable of fitting and attaching both the fitting ends of the receiving plate 2 of the developer vessel thereto and supporting them thereon, a developer-receiving portion 52 for receiving the developer from the opening 23 of the developer vessel and a developer-delivering mechanism 53 for feeding the developer in the developer-receiving portion 52 to a known magnetic brush roller or stirring roller (not shown). The fitting portion 51 comprises an upper frame 54 and a lower frame 55, which are spaced from each other by a certain distance. A sealing member 56 for effecting sealing to the receiving plate 2, which is composed, for example, of a polyurethane foam layer, is formed on the lower frame 55. The developer-delivering mechanism 53 can be a spiral conveyor driven by a motor 57, and in order to assuredly discharge the developer from the developer vessel as the hopper, a hammer 59 intermittently driven by the motor 57 through a cam mechanism 58 can be disposed in the developer-delivering mechanism 53. A positioning engagement projection 60 to be engaged with the engagement hole 28 of the receiving plate is arranged in front of the developer supply zone 5.

Figure 7:
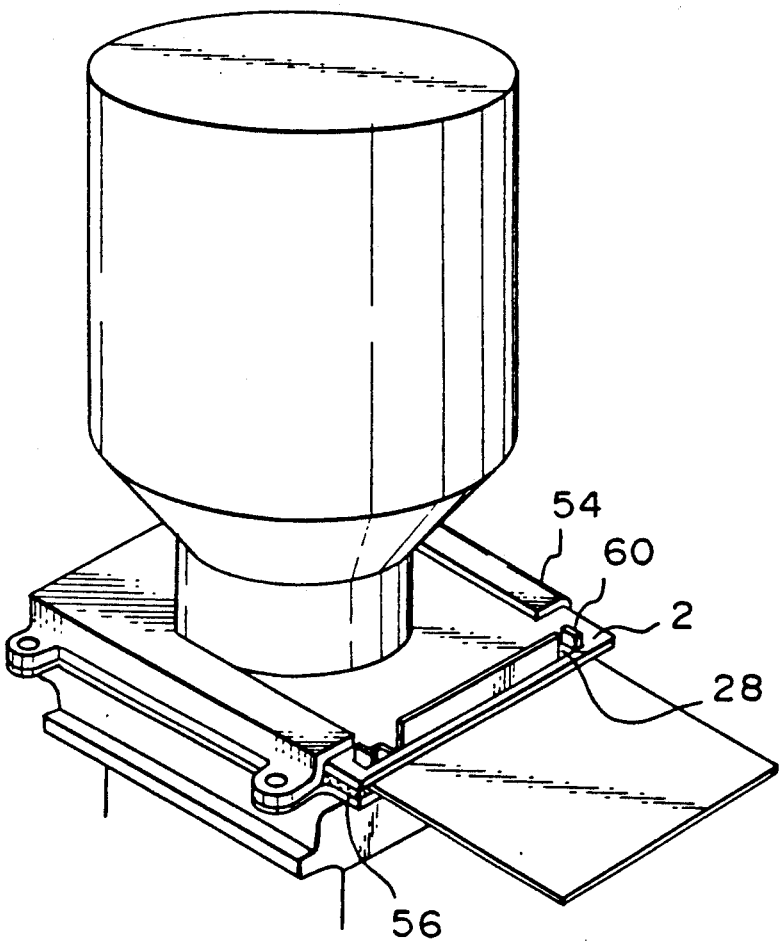
FIG. 7 is a diagram illustrating the state where the developer vessel according to the embodiment of the present invention is attached to the developing device.
Figure 8A:
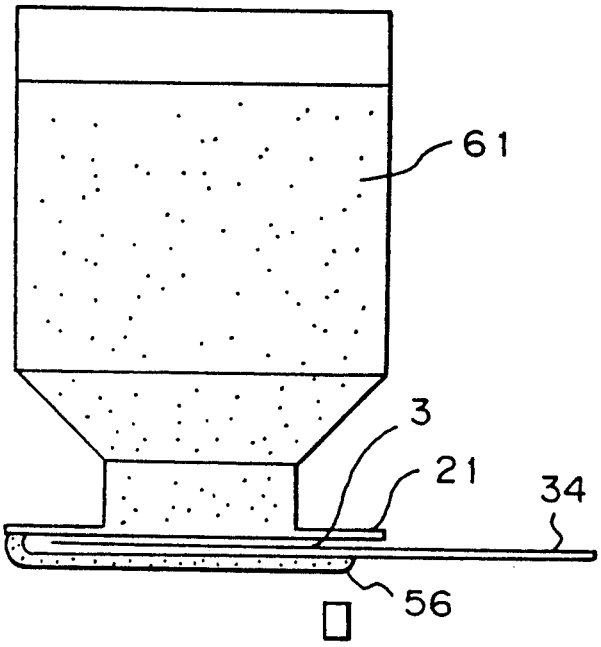
FIG. 8 is a diagram illustrating the movements of a seal member and an opening tab when the opening tab is peeled in the state where the developer vessel according to the embodiment of the present invention is attached to the developing device, in which FIG. 8 (*a*) shows the state before peeling and FIG. 8 (*b*) shows the state during peeling.
Figure 8B:
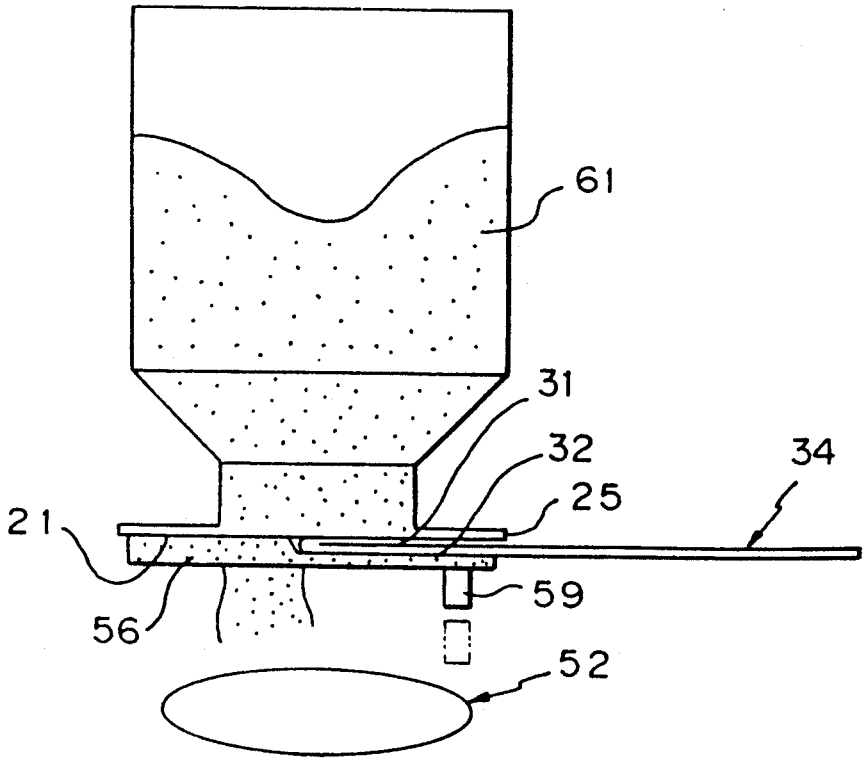

When the developer vessel is attached to the developing device of the copying machine and used as the hopper, at first, the shutter 4 is dismounted from the receiving plate 2, and then, as shown in FIG. 7, the developer vessel is fitted and inserted between the upper frame 54 and the sealing member 56 of the lower frame 55 of the developer supply zone 5 in such a manner that the receiving plate 2 is located below and the fitting end 24 of the receiving plate 2 is located ahead. At the time of insertion of the receiving plate, the fitting and attaching side edges 22*a* (22*b*) of the receiving plate 2 slide between the upper frame 54 and the sealing member 56 of the lower frame 55 to effect fitting and insertion, and the positioning engagement projection 60 is engaged with the engagement hole 28 of the receiving plate 2, whereby the receiving plate 2 is attached to the developer supply zone 5 in the correctly positioned state. As shown in FIG. 8-(*a*), in this positioned state, the opening tab film 3 is kept sealed to the supporting surface 21 of the receiving plate 2, but the grip portion 34 of the opening tab 3 protrudes outward (front side) from the sealing member 56 of the lower frame 55.

At the time of opening, as shown in FIG. 8-(*b*), the grip portion 34 of the opening tab 3 is gripped by the fingers and pulled toward an operator. By this pulling, the lapel portion 32 of the opening tab 3 is allowed to slide between the supporting surface 21 and the sealing member 56 toward the operator and the sealed portion 31 of the opening tab 3 is gradually peeled from the fitting end 24 toward the opposite end 25 to effect opening of the opening 23. At this time, the sealing member 56 allows peeling of the opening tab 3 but always presses the opening tab 3 by an elastic pressure to prevent scattering of the developer powder 61. Thus, the developer powder 61 is discharged to the developer-receiving portion 52 through the opening 23 and is fed to the developing mechanism through the developer-delivering mechanism 53. The receiving plate 2 of the developer vessel is intermittently hit by the hammer 59 to give vibrations to the receiving plate 2, whereby discharge of the developer 61 can be performed smoothly so far as the developer is present in the vessel.

Figure 9:
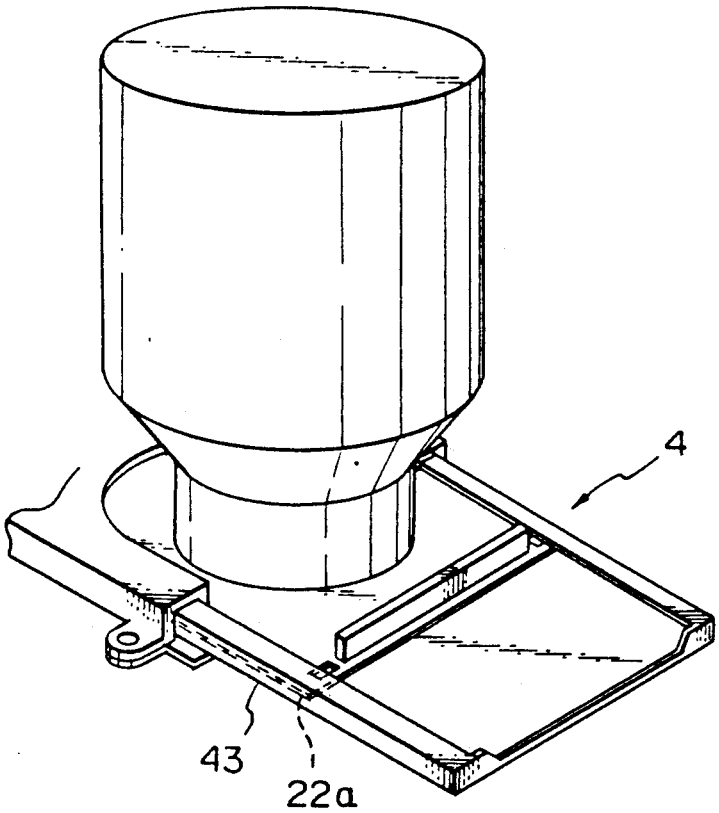
FIG. 9 is a diagram illustrating the state where the developer vessel according to the embodiment of the present invention is dismounted from the developing device.

When the developer is consumed, the grip portion 29 of the receiving plate 2 is gripped, lifted up slightly and pulled toward the operator, whereby the engagement between the positioning engagement projection 60 of the developer supply zone 5 and the engagement hole 28 of the receiving plate 2 is released and the fitting side edges 22*a* (22*b*) of the receiving plate 2 are slid between the upper frame 54 and the sealing member 56 of the lower frame 55 to detach the entire developer vessel from the developing device. If the shutter 4 is engaged with the fitting side edges 22*a* (22*b*) of the receiving plate 2 through the concave groove 43 of the engagement portion 41 and the vessel is taken out in such manner that the receiving plate 2 gradually overlaps the shutter 4, as shown in FIG. 9, scattering of a very slight amount of the developer powder left adhering to the developer vessel can be completely prevented.

Various modifications can be made to the above-mentioned vessel of the present invention without departing from the spirit set forth in the appended claims.

For example, if the vessel proper 1 is prepared by blow forming and the receiving plate 2 is prepared by injection forming and both the members are assembled, as shown in FIGS. 1 through 9, there can be attained various advantages. Namely, the vessel proper can be manufactured at a relatively low cost and the amount used of the resin can be reduced. Furthermore, if a plurality of kinds of the vessel proper are prepared for one kind of the receiving plate, various combinations coping with a variety of copying machines and a variety of amounts filled of the developer can be provided.

Figure 10:
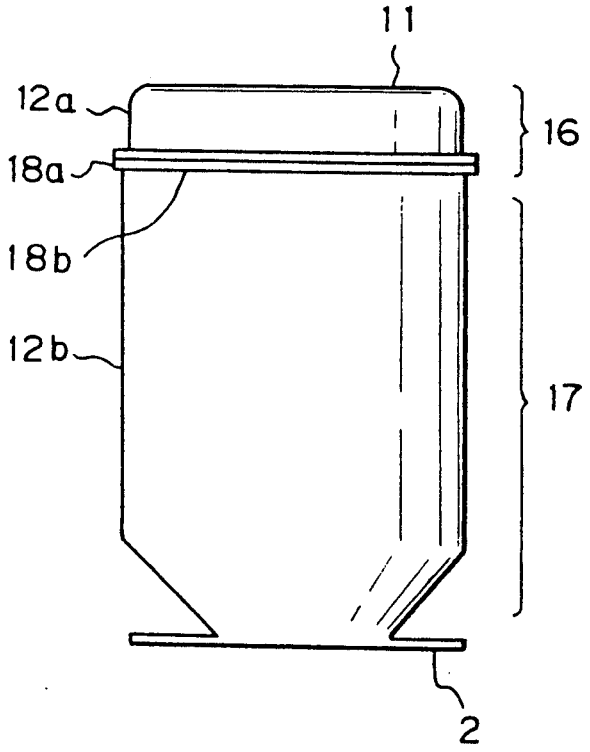
FIG. 10 is a diagram illustrating a developer vessel according to another embodiment of the present invention.

It must be understood that the vessel proper 1 and the receiving plate 2 are not limited to those of the above-mentioned embodiment. For example, as shown in FIG. 10 illustrating another embodiment of the present invention, the vessel proper 1 can be constructed by an upper portion 16 and a lower portion 17 formed integrally with the receiving plate 2. The upper portion 16 is prepared, for example, by injection forming and comprises a closed portion 11 acting as the bottom when the vessel is used as the packaging vessel and acting as the top when the vessel is used as the hopper, a short barrel 12*a* and a flange 18*a* arranged on the open end of the barrel 12*a*. The lower portion 17 is prepared integrally with the receiving plate 2 by injection forming and comprises a relatively long barrel 12*b*, an inclined part 13 and a flange 18*b* formed on the open end of the barrel 12*b*. The upper portion 16 and lower portion 17 are integrated with each other by ultrasonic welding or other welding between the flanges 18*a* and 18*b*.

In order to prevent scattering of the developer powder at the time of detachment of the developer vessel, it is preferred that the shutter 4 should have a structure as shown in FIG. 1. However, it must be understood that in order to protect the opening tab 3 attached to the receiving plate 2, the shutter 4 can preferably have an engagement part to be fitted to the periphery of the receiving plate.

Figure 11:
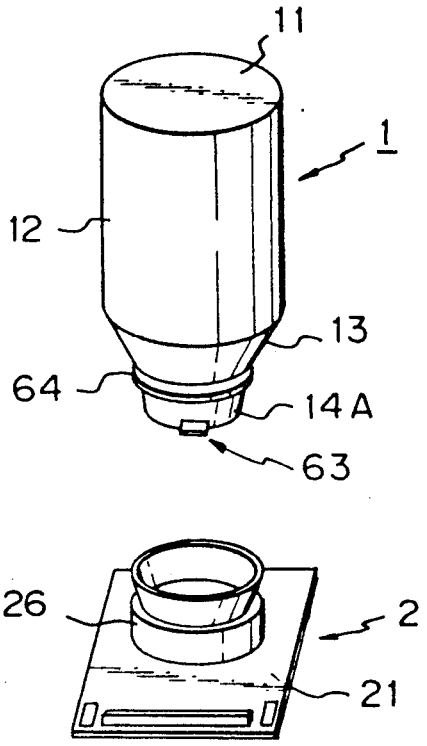
FIG. 11 is a perspective view illustrating systematically a developer vessel according to still another embodiment of the present invention while disintegrating it into two parts.
Figure 13:
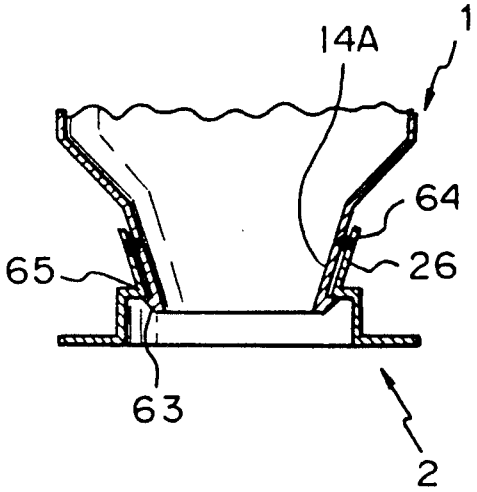
FIG. 13 is an enlarged view of the fitting portion between a vessel proper and a receiving plate of the vessel shown in FIG. 12, which illustrates the section taken along the line XIII—XIII in FIG. 12.
Figure 12:
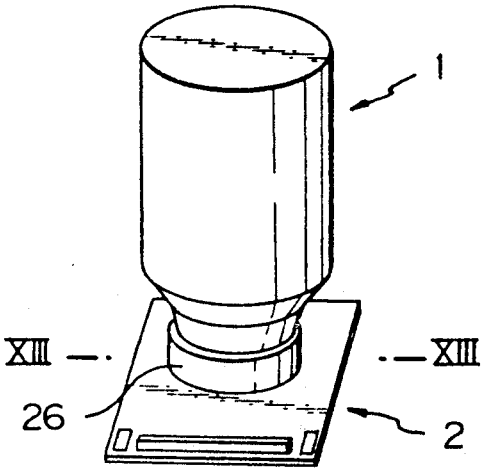
FIG. 12 is a perspective illustrating the state where the two parts shown in FIG. 11 are easily assembled.

Referring to FIGS. 11, 12 and 13 illustrating still another embodiment of the developer vessel of the present invention, the vessel proper 1 has a tapered short cylindrical neck 14A on the top end of the inclined portion 13, and a plurality of projections 63 extending outward of the radius is formed on the outer periphery of the neck 14A (see FIG. 11). A sealing O-ring 64 is arranged on the outer periphery of the tapered neck 14A.

The receiving plate 2 has a connecting part 26 having a shape corresponding to the outer periphery of the neck 14A of the vessel proper 1 on the side opposite to the flat supporting surface 21, and an engagement part (shoulder) 65 to be engaged with the above-mentioned projections 63 is formed on the top end (minimum diameter portion) of this connecting part 26. By pushing the neck 14A of the vessel proper into the connecting part 26, the projections 63 are engaged with the engagement part 65, whereby the vessel proper 1 and the receiving plate 2 are integrated with each other. Moreover, since the O-ring 64 is disposed, the sealing can be attained between the inner circumference of the connecting part 26 and the outer periphery of the neck 14A even if a certain clearance or dimensional error is present between them.

In the foregoing embodiments, the vessel proper and receiving plate are integrated with each other by mechanical clamping. However, it must be understood that the vessel proper and the receiving plate can be integrated by such means as bonding, heat sealing and ultrasonic welding.

In order to prevent intrusion of moisture into the developer, it is preferred that the vessel proper 1 and receiving plate 2 be composed of a moisture-resistant resin, especially an olefin resin such as polyethylene, polypropylene or an ethylene/propylene copolymer.

The developer vessel of the present invention has double actions. That is, the developer vessel of the present invention is used not only as a packaging vessel for containing the developer in the sealed state but also as a developer hopper attached to the developing device. This developer vessel can be opened after it has been attached to the developing device as the developer hopper, and the developer vessel can be opened and attached without scattering the developer in the environment. Accordingly, prominent advantages can be attained by the present invention.

We claim:

1. A developer vessel for use as a developer hopper and being attachable to a developing device of an electrophotographic copying machine comprising:

a) a vessel proper having a closed top, a barrel and a tapered inclined portion continuous to said barrel;

b) a receiving plate which is removably attachable to said vessel proper, said receiving plate further comprising:

i) a substantially flat supporting surface, said flat supporting surface having a pair of substantially straight side edges for attachment to a said developing device;

ii) an opening which is in communication with said vessel proper; and iii) an opening device comprising a film which covers said opening and is peelably bonded to said flat supporting surface; and c) a shutter comprising a plate having on each side edge thereof a concave groove, said concave grooves being configured to engage said pair of substantially straight side edges of said flat supporting surface of said receiving plate;

d) whereby said shutter is designed to receive and engage said receiving plate of said developer vessel when said developer vessel is removed from said developer device such that said plate of said shutter covers said opening in said receiving plate to prevent scattering of developer during removal of said developer vessel.

2. The developer vessel of claim 1, wherein said film has a width smaller than the width of said receiving plate, a length such that said film is folded at the end of said receiving plate designed to be inserted into said developing device, and a lapel portion that protrudes from the end of the receiving plate opposite said end designed to be inserted into said developing device, such that said film may remain peelably bonded to said flat supporting surface or may be removed therefrom while said shutter engages said receiving plate.

3. A developer vessel according to claim 2, wherein said vessel proper has a short cylindrical neck adjacent said inclined portion, said short cylindrical neck having a screw formed on the outer periphery thereof, and said receiving plate has on the side opposite said flat supporting surface a short cylindrical connecting portion surrounding said opening, said short cylindrical portion having a screw formed on the inner circumference thereof, said screw of said neck designed to engage said screw of said connecting portion to make said receiving plate removably attachable to said vessel proper.

4. The developer vessel of claim 3, wherein said vessel proper is integrally blow-formed from a plastic material and said receiving plate is integrally injection-formed from a plastic material.

5. A developer vessel according to claim 2, wherein said vessel proper has a short cylindrical neck adjacent said inclined portion, said short cylindrical neck having a plurality of projections extending outward of the radius on the outer periphery thereof, and said receiving plate has on the side opposite said flat supporting surface a short cylindrical connecting portion surrounding said opening, said short cylindrical portion having an engagement part, said projections of said neck designed to engage said engagement part of said connecting portion to make said receiving plate removably attachable to said vessel proper.

6. The developer vessel of claim 5, wherein said vessel proper is integrally blow-formed from a plastic material and said receiving plate is integrally injection-formed from a plastic material.

7. The developer vessel according to claim 5, further including an O-ring disposed between an outer surface of said vessel proper and an inner surface of said short cylindrical connecting portion to facilitate sealing between said vessel proper and said receiving plate.

* * * * *